United States Patent [19]

Millis et al.

[11] Patent Number: 4,989,811

[45] Date of Patent: Feb. 5, 1991

[54] ATTACHABLE BABY BOTTLE HOLDER WITH AN ATTACHING MECHANISM

[76] Inventors: Patricia C. Millis; H. Lowell Millis, III, both of 2422 E. Locust Ave., Orange, Calif. 92667

[21] Appl. No.: 421,366

[22] Filed: Oct. 13, 1989

[51] Int. Cl.[5] ..... A47D 15/00

[52] U.S. Cl. ..... 248/104; 215/13.1; 248/205.2

[58] Field of Search ..... 248/104, 103, 102, 205.2; 215/11.6, 13.1

[56] References Cited

U.S. PATENT DOCUMENTS

| | | | |
|---|---|---|---|
| 2,182,164 | 12/1939 | Rosenberg | 248/104 |
| 2,399,320 | 4/1946 | Brose et al. | 248/104 |
| 2,416,812 | 3/1947 | Bailey | 248/104 |
| 2,428,724 | 10/1947 | Stretz | 248/104 |
| 2,452,749 | 11/1948 | Guden | 248/104 |
| 2,518,862 | 8/1950 | Cain et al. | 248/104 |
| 2,545,143 | 3/1951 | Pittman | 248/104 |
| 2,579,701 | 12/1951 | Ridey et al. | 215/11.6 X |
| 3,180,600 | 4/1965 | Kopec | 248/104 |
| 3,696,233 | 10/1972 | Pulsifer | 248/103 X |
| 3,718,360 | 2/1973 | Knutzen | 294/27 H |
| 4,076,139 | 2/1978 | Larson | 215/11 |
| 4,114,847 | 9/1978 | Bogensberger | 248/104 |
| 4,215,785 | 3/1979 | Schwaiger | 215/11 |
| 4,416,438 | 11/1983 | King | 248/104 X |
| 4,417,710 | 11/1983 | Adair | 248/205.2 X |
| 4,498,613 | 2/1985 | Donahue et al. | 248/102 X |
| 4,718,623 | 1/1988 | McClure | 248/205.2 X |
| 4,797,040 | 1/1989 | Hibbard | 248/205.2 X |
| 4,871,597 | 10/1989 | Hobson | 215/13.1 X |

FOREIGN PATENT DOCUMENTS

| | | | |
|---|---|---|---|
| 0589203 | 6/1947 | United Kingdom | 248/104 |
| 0990011 | 4/1965 | United Kingdom | 215/13.1 |

*Primary Examiner*—Ramon O. Ramirez

*Attorney, Agent, or Firm*—Hugh L. Millis, Jr.

[57] ABSTRACT

The baby bottle holder according to the present invention is composed of a sleeve of foam rubber material having a circular bottom piece of the same material which together form a cylindrical jacket for holding the bottle. In addition, one end of an elastic strap is attached to the sleeve near its top while a hoop and hook fastener arrangement is attached to the other end of the strap. The jacket and bottle may be thus secured to any suitable nearby object having an unobstructed or free cross-sectional area by the strap and fastener. The jacket thus serves to both thermally insulate and protect the bottle while the strap restricts the movement of the jacket and bottle whenever it is released by the baby using it thereby greatly simplifying the bottle's retrieval.

7 Claims, 1 Drawing Sheet

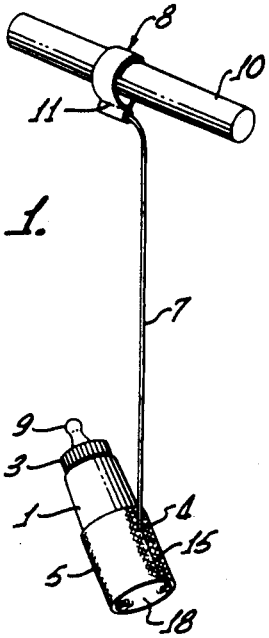
FIG. 1.
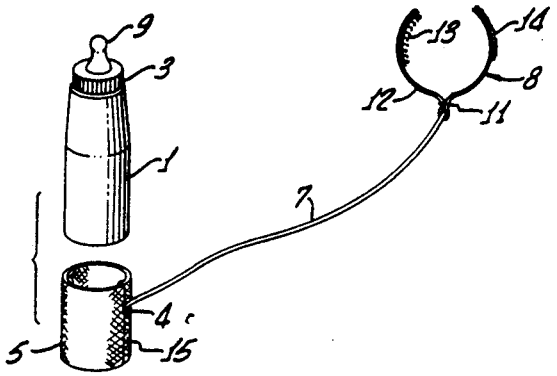
FIG. 2.
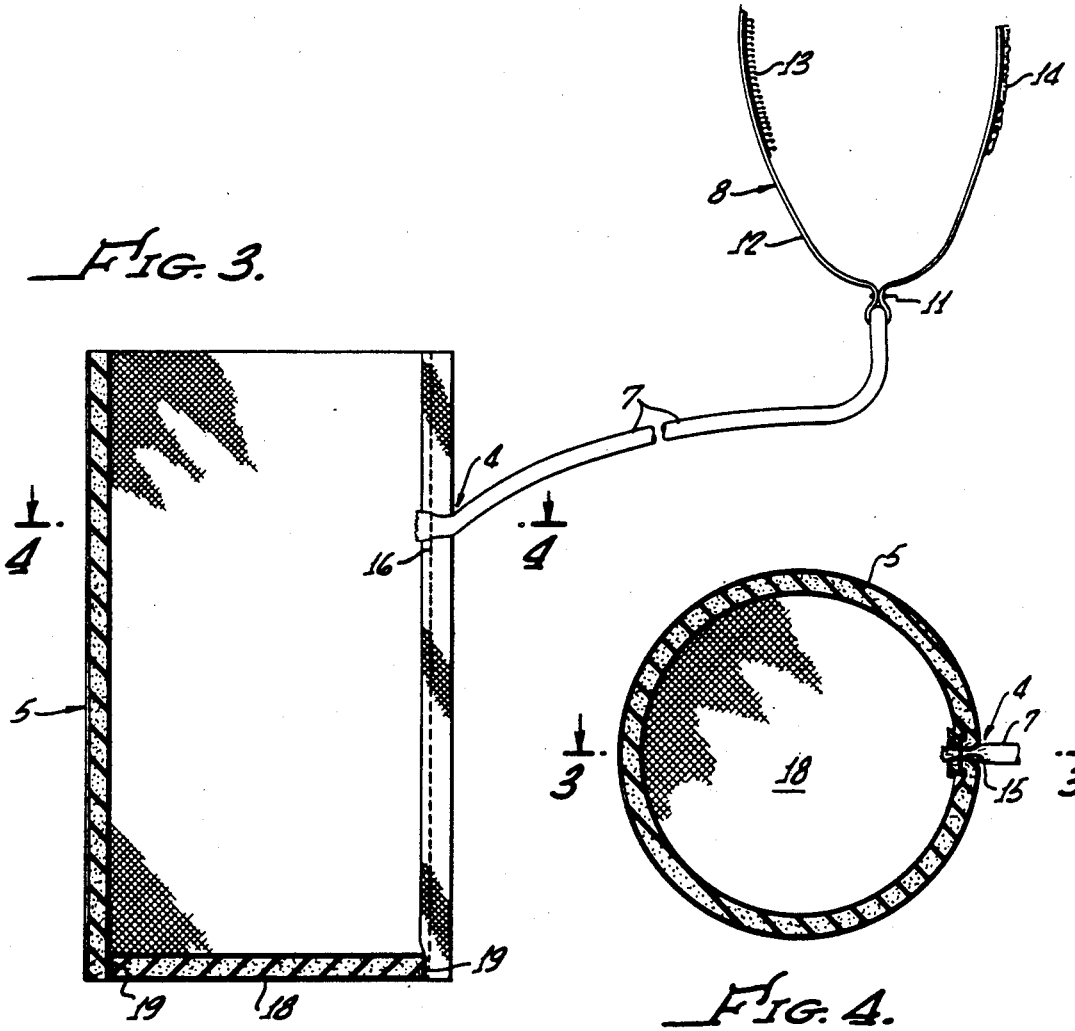
FIG. 3.
FIG. 4.

ATTACHABLE BABY BOTTLE HOLDER WITH AN ATTACHING MECHANISM

BACKGROUND OF THE INVENTION

This invention relates to a holder for a baby bottle which thermally insulates the bottle's contents and includes a strap and fastener by which the bottle and holder may be attached and hence secured to any nearby object such as the arm of a highchair, etc., having a free or unrestricted cross-sectional area of suitable dimensions. This invention thus acts to restrain the bottle from any deliberate or inadvertent release by the baby holding it. This feature makes the baby bottle holder of the present invention particularly appropriate for use with infants mature enough to hold and manipulate the bottle, that is, those infants whose ages range from the immediate pretoddler stage which starts at around 10 months to several years of age or whenever they give up their bottles.

Small infants are well-known for their intransigence in holding toys, books, feeding objects, and other articles in their hands. They often will, without apparent provocation, release or throw down any hand-held object. Generally, no unpleasant results occur since any other object can be substituted for the one released and the baby satisfied. A problem can arise, however, when the baby is nursing on a bottle and drops or throws down the bottle. First of all, the bottle is often used as a pacifying instrument, particularly in public or in an automobile, and its release is often accompanied by the baby's demand for its return by a loud vocal display, a feature not generally appreciated by the baby's handlers or, particularly, by nearby persons in public places. Next, the bottle may come to rest in some inconvenient place, say under the car seat or under the table at a restaurant where its immediate retrieval is either dangerous (in a car) or embarrassing (in a restaurant). There is also the factor both of the mess caused by any spillage from the contents of the bottle and the potential damage either to the bottle or to the object hit by the bottle following its release.

These problems are readily overcome by the bottle holder, strap and fastener of the present invention since the bottle, through the holder and strap, may be secured to any suitable nearby object. It is thus restrained when thrown down by the baby and thus both protected from being damaged itself and prevented from damaging nearby objects. The bottle and holder's final position will always be fixed as determined by the strap and hence readily retrieved for handing back to the baby.

The most pertinent prior art which has been found is in Patent Number 3,718,360 to Frances M. Knutzen, dated Feb. 27, 1973. This invention discloses a plastic sleeve into which the baby bottle is inserted. The sleeve includes a pair of attached circular handles which are adapted to be grasped by the baby without having to turn or rotate its wrists. The patent suggests several details including the size and placements of the handles on the sleeve for making the bottle and holder easier to be held by the baby. there is no suggestion or teaching in the patent for securing the bottle against droppage, either accidentally or on purpose. In fact, the handles may actually aid the baby in throwing the bottle thereby giving it a longer trajectory than would be possible without them. Thus, the difficulty in retrieving a bottle held in Knutzen's bottle holder which has been thrown may be increased over that of a plain bottle.

This result, of course, is directly contrary to that provided by Applicants invention which physically restrains the bottle when released.

SUMMARY OF THE INVENTION

This invention relates to a holder for a baby bottle and, more particularly, to a baby bottle holder which protects the bottle, thermally insulates its contents and additionally includes a fastener by which the bottle and holder combination may be secured to any nearby object suitable for the fastener, such as the arm of a highchair, car window handle, etc. to restrain the bottle's movement if it should be turned loose or thrown by the baby using it. The bottle can thus be readily retrieved using the strap which may not be possible for an unrestrained, plain bottle in the event it came to rest under some furniture, the car seat, etc. where its retrieval could be both time consuming and bothersome. In addition, since the bottle will remain upright due to the strap being attached to the jacket at a point near the top of the jacket, the contents of the bottle will not be spilled when released by the baby whereas an unprotected bottle, when discarded, can result in spillage and stains as well as damage to the surface and adjacent areas where the bottle may land.

It is, accordingly, the principal object of the present invention to provide a jacket for holding a baby bottle. the jacket including a connected strap and fastener by which the combination may be attached to any nearby suitable object thus restraining the bottle whenever it is dropped or thrown by the baby using it.

Another object of the present invention to provide a combined thermally insulating and protective jacket for a baby bottle where one end of a strap is attached to the jacket and a fastener is attached to the other end of the strap such that the fastener, when attached to any suitable nearby object acts, through the strap, to restrain the movement of the jacket and enclosed bottle when thrown or dropped by the baby.

Still another object of the present invention is to provide a baby bottle holder which both secures the bottle and nearby objects from damage when the bottle is dropped or thrown, the baby bottle holder including a jacket surrounding the bottle, and a strap one end of which is secured to the jacket and the other end of which is secured to a fastener which, in turn, can be attached to any nearby suitable object for securing the baby bottle holder.

Other objects, features and attendant advantages of the present invention will become more apparent to those skilled in the art as the following disclosure is set forth including a detailed description of a preferred embodiment of the invention as illustrated in the accompanying sheet of drawings, in which:

BRIEF DESCRIPTION OF THE DRAWINGS

FIG. 1 illustrates the baby bottle holder, strap and fastener according to the present invention as attached to a suitable nearby object;

FIG. 2 shows the bottle removed from the jacket portion of the present invention;

FIG. 3 shows a cutaway view of the jacket through the seam where the strap is attached to the jacket as indicated by sectional lines 3—3 in FIG. 4 and FIG. 4 is a cross-sectional view of the jacket along cross-section 4—4 in FIG. 3.

DESCRIPTION OF THE PREFERRED EMBODIMENT OF THE PRESENT INVENTION

FIG. 1 shows a general view of the baby bottle, jacket, strap and fastener combination according to the present invention as it is attached at a point 4 to a suitable, nearby object by its fastener. In particular, a bottle 1 with a cap 3 and nipple 9 is inserted into and held within a jacket 5. One end of a strap 7 is attached to jacket 5 near the top of a vertical seam 15, shown in more detail in the following FIG. 4. This point of attachment near the top of jacket 5 is substantially above the combined jacket and bottle's center of gravity and acts to maintain the bottle in a substantially upright position in its free-hanging position thus minimizing any bottle spillage. Strap 7, described in more detail later, is readily flexible, being made, for example, out of elastic cord material, so that the bottle and holder can be readily handled, moved and, in general, freely manipulated by the infant holding it. This characteristic meets the needs of the infant age-range, from immediate pre-toddler up to several years of age, who are intended to use the baby bottle holder according to the present invention.

A fastener, shown generally at 8 in this Figure shown in more detail in the following FIG. 3, is attached at 11 to the other end of strap 7. Fastener 8 may be wrapped around and secured, as shown in the Figure, to a suitable nearby object 10, that is, one having a free or unobstructed cross-sectional area represented, for example, by the arm of a chair, an automobile handle or post, a highchair arm, etc.

FIG. 2 illustrates additional details of the combination according to the present invention. Bottle 1 is shown separated from jacket 5 and an end view of fastener 8 indicates, in conjunction with FIG. 1, that it is composed of a continuous rectangular crosspiece 12, of heavy cloth material such as nylon webbing, for example. Crosspiece 12 has two complementary hook and hoop fastener strip sections 13 and 14 which are attached, as by sewing, on opposite sides to its two ends. In particular, hook section 13 is attached to the inside of crosspiece 12 and hoop section 14 to the outside of crosspiece 12. Sections 13 and 14 enable the crosspiece 12 to be secured around an element with a free cross-sectional area, as in FIG. 1, by pressing together sections 13 and 14 following their general alignment. Also, the fastener, strap jacket and bottle can be readily freed from any support by simply pulling sections 13 and 14 apart. Hook and hoop fasteners are better known under the trade name of Velcro.

Additional details of the holder are shown in FIGS. 3 and 4. FIG. 3 is a longitudinal cross-sectional view taken along lines 3—3 of FIG. 4 while FIG. 4 is a radial cross-sectional view taken along lines 4—4 of FIG. 3. FIG. 3 shows additional details of the jacket 5 construction and its combination with strap 7. Jacket 5 is formed initially from a rectangular piece of $\frac{1}{8}$th inch thick material, preferably of a foam rubber variety having a cushioning effect, such as a neoprene covered cloth, where the cloth may be, for example, a pattern-imprinted nylon sheet. The material is then curved to form a sleeve or cylinder and the two mating or abutting edges folded inwardly at right angles to form a lip with protrudes inwardly an amount approximately 2 times the material's thickness, or about $\frac{1}{4}$th of an inch based on the preferred nylon-covered neoprene material noted above. The lip extends along the entire inner seam formed by the edges of sleeve. The free end of strap 7 is inserted at point 4 between the lips of the jacket 5 material and the resulting lips, including the end of strap 7, are sewn together, as indicated by the thread 16. Point 4 is preferably near the top of the seam to give the jacket and bottle a substantially upright rest position thereby eliminating any bottle spillage.

A circular bottom piece 18, made of the jacket 5 type of material, has a diameter corresponding to the inner circumference of jacket 5. It is glued, as indicated by the shading 19 in FIG. 3, around its periphery to the bottom of jacket 5's inner surface, to thereby complete the structure of jacket 5.

As will be appreciated by those skilled in the art, the actual type of materials and/or fabrics used for the various pieces making up the bottle holder and strap of the present invention, including their dimensions, are in no way limiting of the scope of this invention. However, some of the preferred materials and their dimensions for the various pieces may be established by way of example only. Strap 7, for example, may be formed from elastic cord material $\frac{1}{8}$th (0.125) of an inch in diameter. An elastic cord of this diameter will be readily flexible and, as noted earlier, enable an infant holding the bottle holder to readily hold, move and manipulate the bottle and holder as is intended in accordance with the present invention. A typical length would be about 8 inches. Crosspiece 12, formed, as noted, from heavy nylon webbing material, may be 1 inch in width and 8 inches long. Crosspiece 12 is attached, at its center viewed along its length, to the end of strap 7 by wrapping the crosspiece 12 material around the strap until the two adjacent surfaces abut one another and then sewing the abutted material together, as indicated at 11. The hook and hoop sections 13 and 14 may have identical dimensions, for example $\frac{3}{4}$th of an inch in width and $1\frac{1}{2}$ inches long. The height of jacket 5 is preferably about 4 inches while the diameter of its inner surface which corresponds to the diameter of bottom piece 18 is preferably about 2 inches or a little less to thereby correspond to the diameter of a typical baby bottle. With this latter restriction, the bottle may be readily inserted into or removed from the jacket as required and yet secured sufficiently by friction between its outer surface and the inner surface of jacket 5 so as not to inadvertently fall out of the jacket by itself or be easily removed by the baby. Point 4, where strap 7 is attached to the jacket may be, for example, about one inch from the top of the jacket. It may also be noted that the neoprene material preferred for jacket 5's wall and bottom offers two principal advantages. The first is that its thermal insulating properties aid in maintaining the bottle and its contents at its original temperature. Secondly, the foam rubber nature of the neoprene material acts as a cushion to absorb any shocks occurring whenever the bottle and holder impact other objects upon being dropped or thrown. Finally, strap 8, in being formed by elastic shock cord material, also acts as a cushion whenever the combination is released to prevent undue stresses at point 4, the point of attachment of strap 7 to jacket 5. This feature serves to increase the useful life span of the bottle-holding combination according to the present invention.

The particular materials noted and the recommended dimensions given are by way of example only and are not intended to be restrictive of the scope of the present invention.

It will be appreciated by those skilled in the art, that the foregoing disclosure relates only to a detailed preferred embodiment of the invention whose spirit and scope is set forth in the appended claims.

What is claimed is:

1. A retrievable baby bottle holding means for use by an infant, said baby bottle holding means being capable of being removably secured to an external support means but freely manipulable by an infant while said holding means is secured to said external support means, said baby bottle holding means comprising:

jacket means adapted to hold a baby bottle;

readily flexible strap means having first and second end sections;

means for securing the first end section of said readily flexible strap means to said jacket means;

fastener means adapted to be removably secured to the external support means; and means for securing said fastener means to the second end section of said readily flexible strap means whereby said baby bottle holding means may be removable secured to said external support means by said fastener means, said readily flexible strap means enabling said bottle holding means to be freely manipulated when held by an infant while said bottle holding means is secured to said external support means and readily retrieved if said bottle holding means is released by the infant;

said jacket means includes cylindrically-shaped sleeve means and circular bottom means fixed to the bottom of said sleeve means, the outer surface of a baby bottle being held within said sleeve means and the bottom of said baby bottle being supported by said bottom means, said sleeve means and said bottom means being formed of a cushioning and thermally insulating material which both cushions said baby bottle against external shocks and thermally insulates its contents.

2. The baby bottle holder according to claim 1 in which said sleeve means is formed of a rectangular piece of said cushioning and thermally-insulating material, said material being formed into a cylindrical shape with lip means formed along its two mating edges, and means for securing said lip means together to maintain said sleeve means in said cylindrical shape, said cylindrical shape having a diameter approximately equal to that of a baby bottle.

3. The baby bottle holder according to claim 1 in which said readily flexible strap means is formed of flexible elastic cord means and said fastener means includes a crosspiece support means having first and second sides and two ends, hoop fastener means secured to the first side of said crosspiece support means at one of its two ends, hook fastener means secured to the second side of said crosspiece support means at the other of its said two ends, and means securing said crosspiece support means to the second end of said readily flexible strap means whereby said hoop fastener means and said hook fastener means may be passed around said external support means and pressed together to thereby removably secure said baby bottle holder to said external support means.

4. A retrievable baby bottle holder for thermally insulating, cushioning and removably securing a baby bottle to an external support means, said holder permitting said baby bottle to be readily manipulated by an infant when said holder is secured to said external support means and retrieved if the bottle is released by the infant, said holder comprising:

fastener means including readily flexible elastic strap means having two end sections, crosspiece support means having two ends and two sides, means for attaching said crosspiece support means to one end section of said readily flexible elastic strap means, hoop fastener means attached to the one end and on one side of said crosspiece support means and hook fastener means attached to the other end and on the other side of said crosspiece support means whereby said crosspiece support means may be curved around said external support means and removably secured by pressing said hook and said hoop fastener means together;

jacket means including a cylindrically shaped sleeve means having an inner diameter corresponding to the baby bottle, bottom means having a diameter corresponding to said inner diameter and means for securing said bottom means to the bottom of said cylindrically shaped sleeve means to thereby form a jacket for said baby bottle; and means for securing the other end section of said readily flexible elastic strap means to said cylindrically-shaped sleeve means whereby said holder may be removably secured to said external support means by said fastener means, said readily flexible elastic strap means permitting said baby bottle in said jacket means to be readily manipulated by an infant when said holder is secured to said external support means and permitting said baby bottle in said jacket means to be readily retrieved if said holder is released by the infant.

5. The baby bottle holder according to claim 4 in which said cylindrically-shaped sleeve means includes rectangular material means, said rectangular material means being rolled into a cylinder to form inner lip means along respective mating edges, the said other end section of said readily flexible elastic strap means being placed between said lip means, and means for securing said lip and the other end of said readily flexible elastic strap means together to integrally join said readily flexible elastic strap means and said jacket means.

6. The baby bottle holder according to claim 5 in which said other end of said readily flexible elastic strap means is inserted into said lip means at a point on said cylindrically-shaped sleeve means above the center of gravity of said jacket means whereby the free-hanging position of said holder from said fastener means is upright thereby minimizing any spillage from a baby bottle held in said holder.

7. The baby bottle holder according to claim 6 in which the rectangular material means of said cylindrically-shaped sleeve means and said bottom means are formed from a cushioning and thermally insulating material whereby a baby bottle held in said jacket means is both cushioned from external shocks and its contents thermally insulated.

* * * * *